US011296393B2

(12) United States Patent
Zhang

(10) Patent No.: US 11,296,393 B2
(45) Date of Patent: Apr. 5, 2022

(54) TM DUAL MODE FILTER

(71) Applicant: Telefonaktiebolaget LM Ericsson (publ), Stockholm (SE)

(72) Inventor: Xiaoliang Zhang, Beijing (CN)

(73) Assignee: Telefonaktiebolaget LM Ericsson (publ), Stockholm (SE)

( * ) Notice: Subject to any disclaimer, the term of this patent is extended or adjusted under 35 U.S.C. 154(b) by 0 days.

(21) Appl. No.: 16/321,074

(22) PCT Filed: Aug. 31, 2016

(86) PCT No.: PCT/CN2016/097586
§ 371 (c)(1),
(2) Date: Jan. 28, 2019

(87) PCT Pub. No.: WO2018/039993
PCT Pub. Date: Mar. 8, 2018

(65) Prior Publication Data

US 2019/0181525 A1 Jun. 13, 2019

(51) Int. Cl.
*H01P 1/208* (2006.01)

(52) U.S. Cl.
CPC ..... *H01P 1/2086* (2013.01)

(58) Field of Classification Search
CPC ..... H01P 1/2086; H01P 1/2084; H01P 1/208
USPC ..... 333/208, 202, 209
See application file for complete search history.

(56) References Cited

U.S. PATENT DOCUMENTS

| | | | | |
|---|---|---|---|---|
| 5,708,404 | A * | 1/1998 | Kurisu | H01P 1/2086 333/202 |
| 5,764,115 | A * | 6/1998 | Hattori | H01P 1/2086 333/202 |
| 5,783,979 | A | 7/1998 | Andoh et al. | |
| 5,831,496 | A * | 11/1998 | Sonoda | H01P 1/2086 333/202 |
| 6,836,198 | B2 * | 12/2004 | Engst | H01P 1/2053 333/202 |
| 2006/0176129 | A1 | 8/2006 | Andreasson et al. | |

FOREIGN PATENT DOCUMENTS

| | | | |
|---|---|---|---|
| CN | 104577269 | A | 4/2015 |
| CN | 204375882 | U | 6/2015 |
| EP | 0759645 | A2 | 2/1997 |
| EP | 0661770 | B1 | 10/2001 |
| WO | 2014/128491 | A1 | 8/2014 |

OTHER PUBLICATIONS

Office Action issued in corresponding EP Application No. 16914559.6 dated Mar. 2, 2020, 08 Pages. The references not cited herein have been previously made of record.

* cited by examiner

*Primary Examiner* — Stephen E. Jones
(74) *Attorney, Agent, or Firm* — Sage Patent Group

(57) ABSTRACT

The present disclosure provides a filter comprises an enclosure having two cavities separated by a wall; a first TM dual-mode resonator and a second TM dual-mode resonator, each TM dual-mode resonator having two modes and comprising a body having a central portion with a plurality of arms extending outwardly from the central portion; a gradient aperture formed in the wall for coupling between two TM dual-mode resonators. The filter is capable of forming two transmission zeros between four resonances modes.

11 Claims, 5 Drawing Sheets

TM DUAL MODE FILTER

TECHNICAL FIELD

The present disclosure relates to filters for wireless communications systems, more particularly, to wireless base station filters.

BACKGROUND

A wireless telecommunication system typically includes a plurality of base stations connected to communication network and each base station includes a RRU (remote radio unit). Microwave cavity filters are passive components in RRU, connected to antenna directly. So they are designed to take high power, low insertion loss and very good return loss in passband. And they are also strict attenuation out-band passband to filter the emission of downlink transmitter (TX) to fulfill 3GPP standard. Dual mode filter can greatly decrease the volume or improve the insertion loss with same volume, which saves about 40% volume compared with traditional ceramic filter with the same insertion loss.

Further, a transmission zero is a frequency at which the transfer function of a linear two-port network has zero transmission. For filters of RRU, rigorous and precise out-band attenuation are both needed so the transmission zero is very critical. However, there are no solutions of realizing two transmission zeros between four resonance modes in TM (transverse magnetic) dual mode filter at present, because the electromagnetic condition inside is very complicated.

There is thus a need for an improved solution for TM dual mode filter.

SUMMARY

It is an object of the present disclosure to provide a new type of TM dual mode filter for RRU, capable of forming two transmission zeros between four resonance modes.

In a first aspect, the present disclosure provides a filter comprising: an enclosure having two cavities separated by a wall; a first TM dual-mode resonator and a second TM dual-mode resonator, each TM dual-mode resonator having two modes and comprising a body having a central portion with a plurality of arms extending outwardly from the central portion; a gradient aperture formed in the wall for coupling between two TM dual-mode resonators.

In an embodiment, the first TM dual-mode resonator has a first arm and a second arm; the second TM dual-mode resonator has a third arm and a fourth arm.

In an embodiment, the first arm is perpendicular to the second arm and the third arm is perpendicular to the fourth arm.

In an embodiment, the first TM dual-mode resonator has a first mode and a second mode; the second TM dual-mode resonator has a third mode and a fourth mode.

In an embodiment, the coupling between two TM dual-mode resonators is a coupling between the first mode and the third mode and a coupling between the second mode and the fourth mode and also a coupling between the first mode and the fourth mode and a coupling between the second mode and the third mode.

In an embodiment, the filter further comprises: a cutting corner at a side of the cavities.

In an embodiment, the direction of the gradient aperture is against to the cutting corner.

In an embodiment, the direction of the gradient aperture is pointing to the cutting corner.

In an embodiment, the filter further comprises: a window formed in the wall and a capacity coupling pin which is across the window.

In an embodiment, the filter further comprises: input pins respectively distributed in the two cavities.

In a second aspect, a network node is provided, wherein the network node comprises the filter described in the first aspect.

With the embodiments of the present disclosure, it can produce two transmission zeros both beyond the passband and below the passband, and the frequency of both transmission zeros can be freely adjusted by the bevel angle of aperture and the capacity coupling pin across the window. The tuning range of frequency is tremendous from quintuple to very near passband. These two transmission zeros make TM dual-mode filter have flexible and stringent attenuation out of passband, and also have flexible topology for filter.

BRIEF DESCRIPTION OF THE DRAWINGS

The above and other objects, features and advantages will be more apparent from the following description of embodiments with reference to the figures, in which.

DETAILED DESCRIPTION

The embodiments of the disclosure will be detailed below with reference to the drawings. It should be noted that the following embodiments are illustrative only, rather than limiting the scope of the disclosure.

Figure 1:
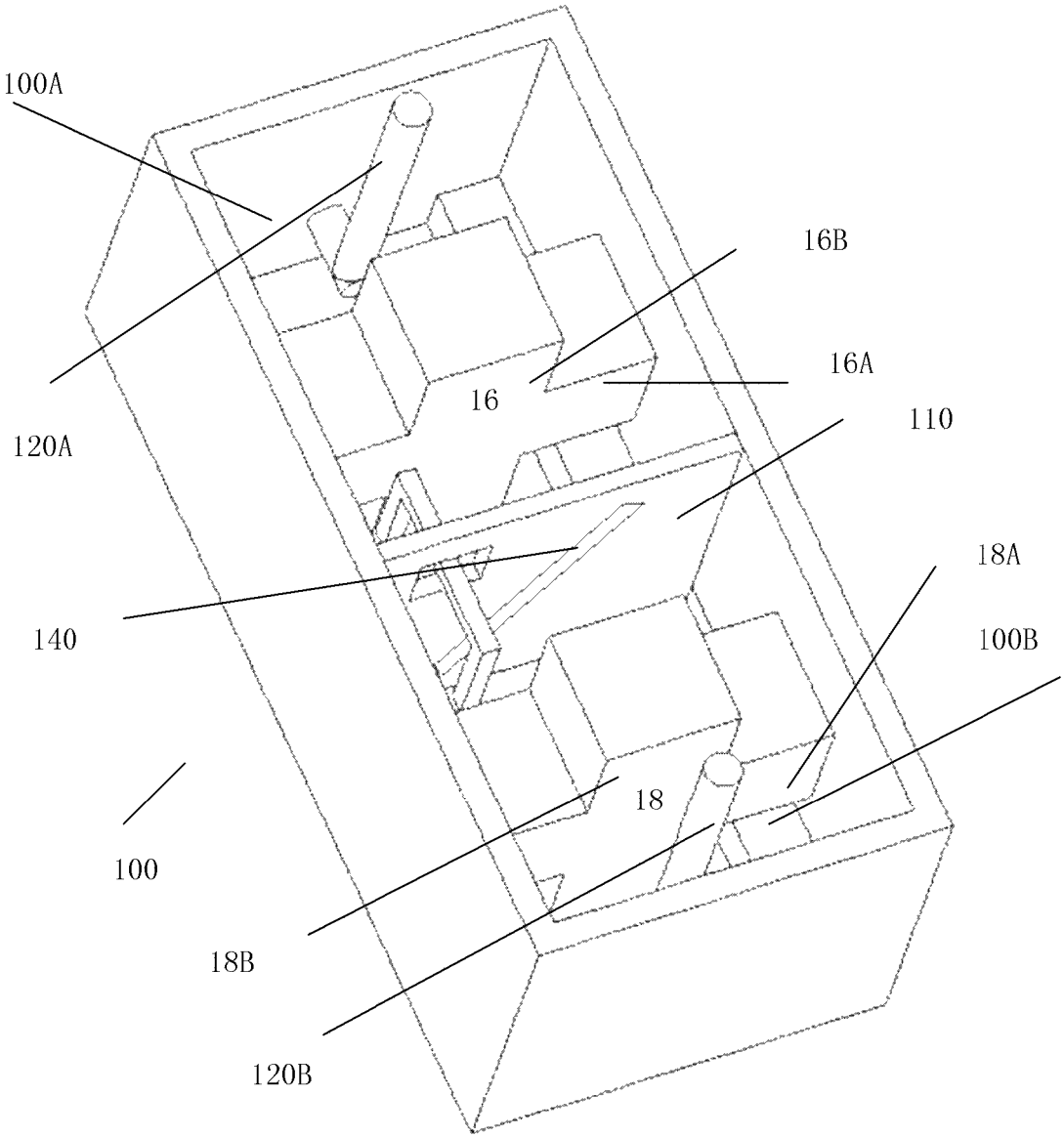
FIG. 1 is a perspective view of a filter according to an embodiment of the present disclosure.

FIG. 1 is a perspective view of a filter according to an embodiment of the present disclosure. The filter 100 provides two cavities 100A and 100B which are separated by a wall 110, wherein each cavity houses a transverse magnetic (TM) dual mode resonator.

A first TM dual mode resonator 16 is formed by resonator members 16A, 16B crossing each other at a mid-point to form a "cross" or "X" in cavity 100A. Resonator members 16A, 16B can be described as a first arm 16A and a second arm 16B too. Further, the first arm 16A indicates a first resonance mode and the second arm 16B indicates a second resonance mode. A second TM dual mode resonator 18 is formed by resonator members 18A, 18B crossing each other at a mid-point to form a "cross" or "X" in cavity 100B. The filter case 100 further houses input pins (i.e., 120A, 120B) coupled to coaxial connectors. Resonator members 18A, 18B can be described as a third arm 18A and a fourth arm 18B too. Further, the third arm 18A indicates a fourth resonance mode and the fourth arm 18B indicates a third resonance mode.

In an embodiment, the first arm 16A is perpendicular to the second arm 16B to ensure a good coupling. The third arm 18A is perpendicular to the fourth arm 18B for the same reason.

A gradient aperture 140 is formed in the wall 110 for coupling between two TM dual-mode resonators. The gradient aperture realizes the coupling and cross coupling between two dual-mode cavities, therefore implementing two transmission zeros both beyond and below the passband. The gradient angle, length, position and direction of the aperture control the coupling and cross coupling, and determine the position of transmission zeros, make it near the passband or far from passband.

In an embodiment, coupling between two TM dual-mode resonators mostly means that coupling between the first mode (the first arm 16A) and the third mode (the fourth arm 18B) and coupling between the second mode (the second arm 16B) and the fourth mode (the third arm 18A). However, coupling between two TM dual-mode resonators also means that coupling between the first mode (the first arm 16A) and the fourth mode (the third arm 18A) and coupling between the second mode (the second arm 16B) and the third mode (the fourth arm 18B).

Figure 4:
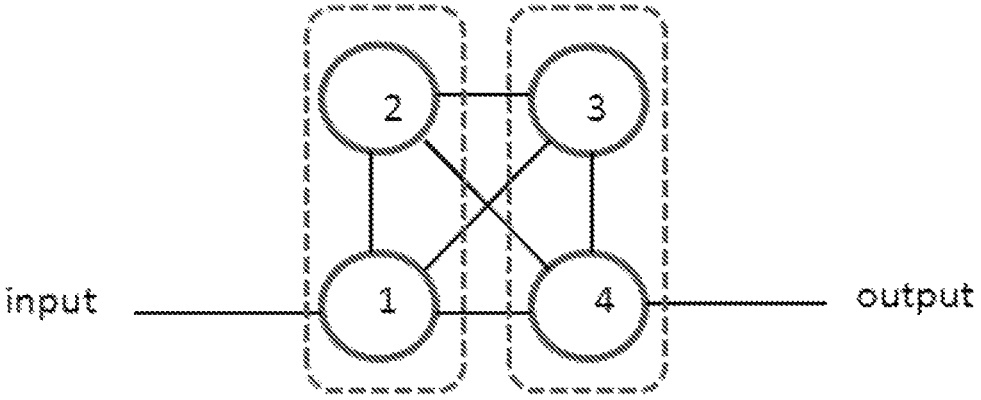
FIG. 4 is a diagram showing an example coupling for a filter including TM dual mode resonators according to an embodiment of the present disclosure.

FIG. 4 is a drawing illustrating the couplings inside each cavity and couplings between two cavities, which means, a diagram showing an example coupling for a filter including TM dual mode resonators according to an embodiment of the present disclosure. Number 1 indicated the first mode, number 2 indicated the second mode, number 3 indicated the third mode and number 4 indicated the fourth mode.

Figure 2:
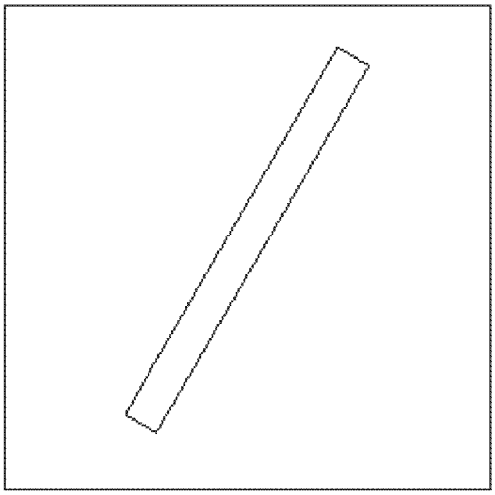
FIG. 2 is a schematic diagram showing an example explaining the method shown in FIG. 1.

FIG. 2 is a drawing illustrating the shape of the gradient aperture 140. The gradient angle of the aperture 140 relatively vertical can be 0 to 45 degrees, and make the transmission zeros close to passband, if the angle reduces, the transmission zeros should gradually far away from passband, and if the angle reduces to 0 degrees, there are no cross coupling between the first mode and the third mode and no cross coupling between the second mode and the fourth mode. Consequently, the transmission zeros are disappeared.

The gradient angle and length of the aperture 140 also control the coupling between the first mode and the fourth mode. The coupling will be stronger if the angle or the length is larger.

Also, the length of the aperture influences the coupling between the second mode and the third mode.

Figure 3:
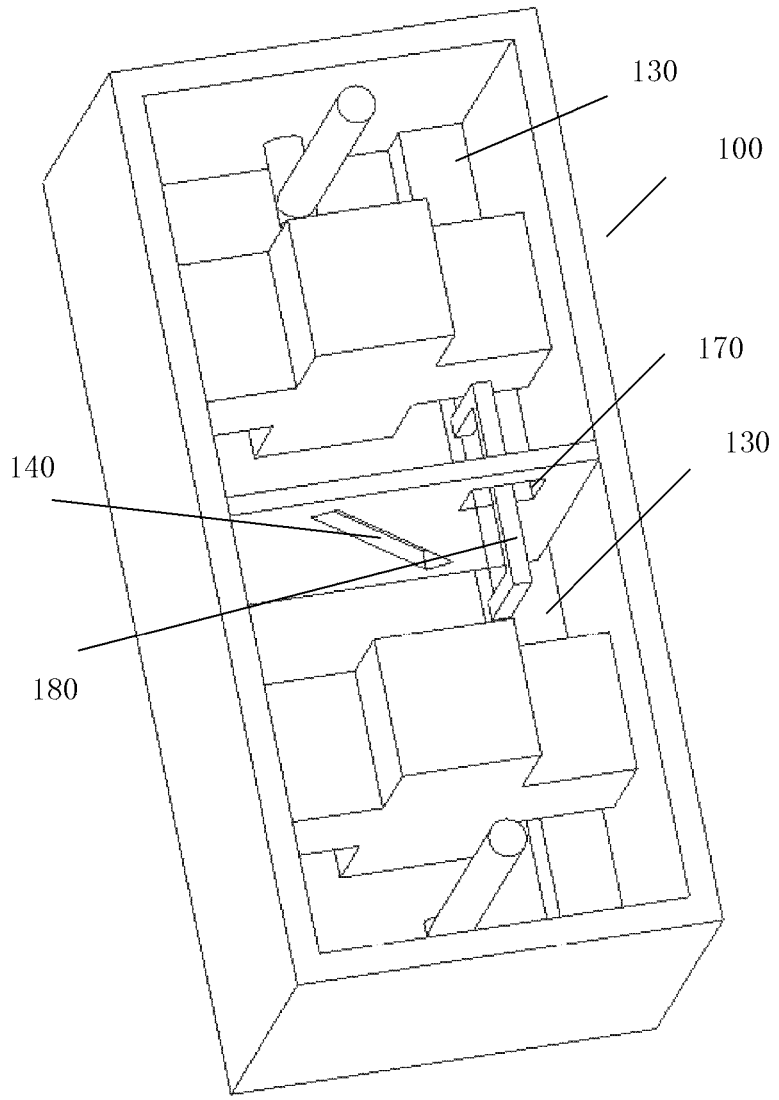
FIG. 3 is a perspective view of a filter according to an embodiment of the present disclosure.

FIG. 3 is a perspective view of a filter according to an embodiment of the present disclosure.

The filter 100 provides a square step in the lower corner, which is named as cutting corner 130 in this disclosure for the coupling between the first resonance mode and the second resonance mode or the coupling between the third resonance mode and the fourth resonance mode. Cutting corner 130 can locate in every side of the filter 100, such as the lower-right side which is showed by FIG. 3.

In the embodiment indicated by FIG. 1, the direction of the gradient aperture 140 is against to the cutting corner 130, in this embodiment, the two transmission zeros are beyond the passband.

On the other hand, as indicated by FIG. 3, the direction of the gradient aperture 140 can be pointing to the cutting corner 130, consequently the two transmission zeros are below the passband.

The embodiments of this disclosure realize two transmission zeros in one filter, but they may overlap because of the strong coupling between the first mode and the fourth mode or the strong coupling between the second mode and the third mode.

Figure 5:
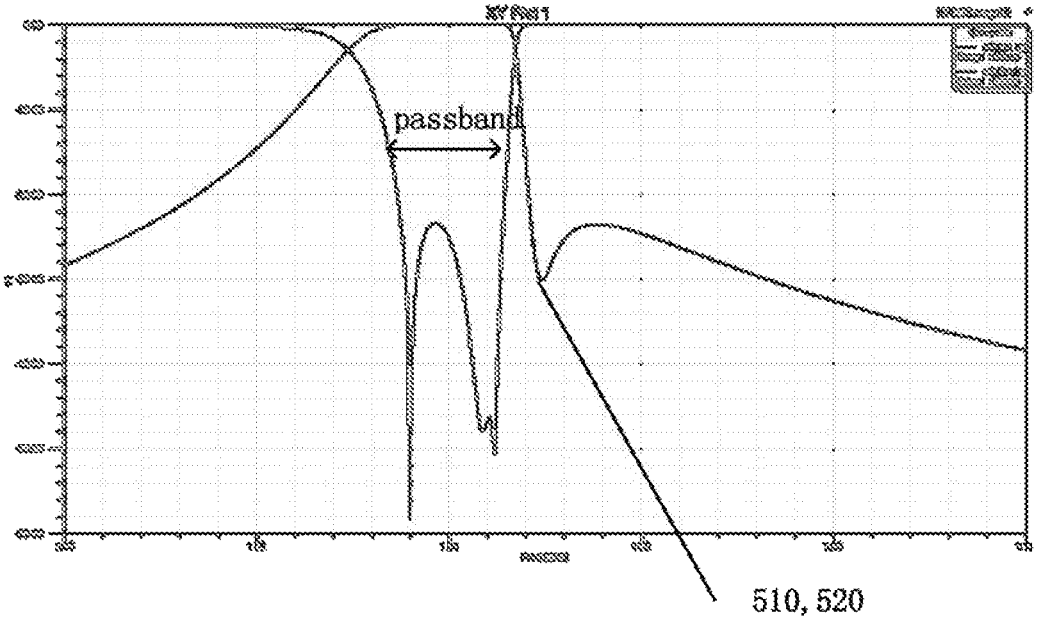
FIG. 5 is a graph showing an example frequency response of the filter of the present disclosure.

FIG. 5 is a graph showing an example frequency response of the filter of the present disclosure, which illustrates the overlap of two transmission zeros. As shown in FIG. 5, transmission zeros 510 and 520 are overlapping.

As also can be seen from FIG. 5, the two transmission zeros 510 and 520 are beyond the passband, which indicates that the direction of the gradient aperture 140 is against to the cutting corner 130.

In an embodiment, a window is formed in the wall and a capacity is provided which is across the window. As shown in FIG. 3, a window 170 is drilled in the wall 110 and a capacity 180 is across the window 170 simply like a pipe. Capacity 180 introduces a weaken inductive coupling between the first mode and the fourth mode, and the two transmission zeros can be separated as shown by FIG. 6.

Figure 6:
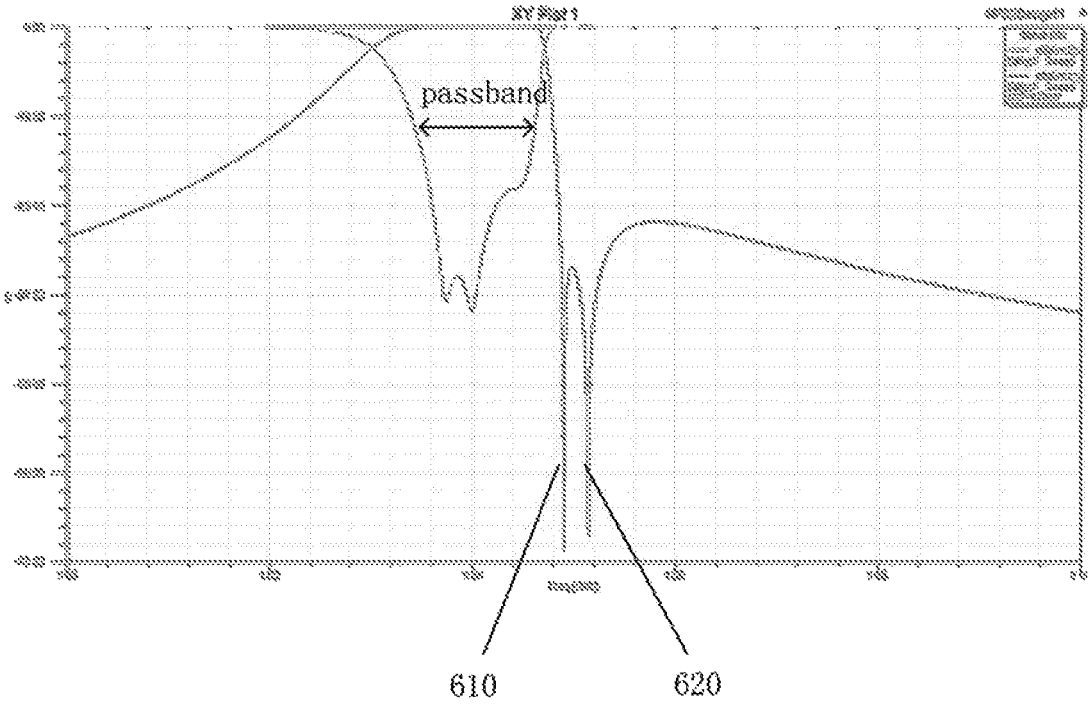
FIG. 6 is a graph showing an example frequency response of the filter of the present disclosure.

FIG. 6 is a graph showing an example frequency response of the filter of the present disclosure, which illustrates the separation of two transmission zeros. As shown in FIG. 6, transmission zeros 610 and 620 are separated.

As also can be seen from FIG. 6, the two transmission zeros 610 and 620 are beyond the passband, which indicates that the direction of the gradient aperture 140 is against to the cutting corner 130.

The present disclosure also provides a network node or a base station, which includes the TM dual mode filter described by the above embodiments. And the network node or base station can be widely implemented in the wireless communication field.

The disclosure has been described above with reference to embodiments thereof. It should be understood that various modifications, alternations and additions can be made by those skilled in the art without departing from the spirits and scope of the disclosure. Therefore, the scope of the disclosure is not limited to the above particular embodiments but only defined by the claims as attached.

The invention claimed is:

1. A filter comprising:

an enclosure having two cavities separated by a wall;

a cutting corner at a side of the cavities;

a first transverse magnetic (TM) dual-mode resonator and a second TM dual-mode resonator, each TM dual-mode resonator having two modes and comprising a body having a central portion with a plurality of arms extending outwardly from the central portion, wherein the first TM dual-mode resonator has a first arm and a second arm, wherein the second TM dual-mode resonator has a third arm and fourth arm; and a gradient aperture formed in the wall for coupling between the first TM dual-mode resonator and the second TM dual-mode resonator, wherein:

the direction of the gradient aperture is against to the cutting corner, the gradient aperture implements transmission zero based on the coupling, a position of the transmission zeros is determined based on at least an angle of the gradient aperture and a length of the gradient aperture, the coupling between the first TM dual-mode resonator and the second TM dual-mode resonator is a coupling between the second arm and the third arm, and the first arm is perpendicular to the second arm and the third arm is perpendicular to the fourth arm.

2. The filter of claim 1, wherein the filter further comprises: a window formed in the wall and a capacity which is across the window.

3. The filter of claim 1, wherein the filter further comprises:

input pins respectively distributed in the two cavities.

4. The filter of claim 1, wherein the first TM dual-mode resonator has a first mode and a second mode, and wherein the second TM dual-mode resonator has a third mode and a fourth mode.

5. The filter of claim 4, wherein the coupling between the first TM dual-mode resonator and the second TM dual-mode resonator is a coupling between the first mode and the third mode or a coupling between the second mode and the fourth mode.

6. A network node comprising:

a filter, wherein the filter comprises:

an enclosure having two cavities separated by a wall;

a cutting corner at a side of the cavities;

a first transverse magnetic (TM) dual-mode resonator and a second TM dual-mode mode resonator, each TM dual-mode resonator having two modes and comprising a body having a central portion with a plurality of arms extending outwardly from the central portion, wherein the first TM dual-mode resonator has a first arm and a second arm, and wherein the second TM dual-mode resonator has a third arm and a fourth arm; and a gradient aperture formed in the wall for coupling between the first TM dual-mode resonator and the second TM dual-mode resonator, wherein the direction of the gradient aperture is against to the cutting corner, wherein the gradient aperture implements transmission zero based on the coupling, wherein a position of the transmission zeros is determined based on at least an angle of the gradient aperture and a length of the gradient aperture, and wherein the coupling between the first TM dual-mode resonator and the second TM dual-mode resonator is a coupling between the first arm and the fourth arm and a coupling between the second arm and the third arm.

7. The network node of claim 6, wherein the first arm is perpendicular to the second arm and the third arm is perpendicular to the fourth arm.

8. The network node of claim 6, wherein the filter further comprises: a window formed in the wall and a capacity which is across the window.

9. The network node of claim 6, wherein the filter further comprises: input pins respectively distributed in the two cavities.

10. The network node of claim 6, wherein the first TM dual-mode resonator has a first mode and a second mode, and wherein the second TM dual-mode resonator has a third mode and a fourth mode.

11. The network node of claim 10, wherein the coupling between the first TM dual-mode resonator and the second TM dual-mode resonator is a coupling between the first mode and the third mode or a coupling between the second mode and the fourth mode.

* * * * *